US011806287B2

(12) United States Patent
Vernon et al.

(10) Patent No.: US 11,806,287 B2
(45) Date of Patent: Nov. 7, 2023

(54) IDENTIFICATION BED

(71) Applicant: VERNON FUNERAL HOMES INC., Mechanicsburg, OH (US)

(72) Inventors: David P Vernon, Urbana, OH (US); Colin D Vernon, Mechanicsburg, OH (US)

(73) Assignee: VERNON FUNERAL HOMES INC., Mechanicsburg, OH (US)

( * ) Notice: Subject to any disclaimer, the term of this patent is extended or adjusted under 35 U.S.C. 154(b) by 35 days.

(21) Appl. No.: 17/652,995

(22) Filed: Mar. 1, 2022

(65) Prior Publication Data

US 2023/0277403 A1 Sep. 7, 2023

(51) Int. Cl.
*A61G 17/04* (2006.01)

(52) U.S. Cl.
CPC ..... *A61G 17/0405* (2017.05); *A61G 17/041* (2016.11); *A61G 17/0407* (2017.05)

(58) Field of Classification Search
CPC ..... A61G 17/0405; A61G 17/041; A61G 17/0407; A61G 17/001
USPC ..... 27/10, 28, 35
See application file for complete search history.

(56) References Cited

U.S. PATENT DOCUMENTS 2,125,546 A * 8/1938 Corr ..... A61G 7/1074 212/343
3,810,282 A * 5/1974 Doggett ..... A61G 17/0166 27/35
4,086,672 A * 5/1978 Nilsson ..... A61G 7/1017 5/85.1
7,302,743 B2 * 12/2007 Fash ..... A61G 17/001 27/35
7,373,704 B1 * 5/2008 Blacklock ..... A61G 7/1044 27/28
8,443,577 B2 * 5/2013 McWilliams ..... A61G 17/0136 27/28
8,914,953 B1 * 12/2014 Thacker ..... A61G 17/0076 27/35
2005/0108863 A1 * 5/2005 Fash ..... A61G 17/001 27/2
2015/0149367 A1 * 5/2015 Thacker ..... A61G 17/041 705/307
2016/0008202 A1 * 1/2016 Davis ..... A61G 17/004 27/10

* cited by examiner

*Primary Examiner* — William L Miller
(74) *Attorney, Agent, or Firm* — Shumaker, Loop & Kendrick, LLP; John A. Miller

(57) ABSTRACT

An identification bed assembly for displaying a body for identification. The bed assembly includes a bed structure having a headboard, a first sub-structure having a head end and a foot end and a second sub-structure having a head end and a foot end, where the head end of the first sub-structure is attached to one side of the headboard and the head end of the second sub-structure is attached to another side of the headboard so that an opening is provided between the first and second sub-structures. The bed structure further includes a door coupled to the foot end of the first sub-structure by hinges and being latchable to the foot end of the second sub-structure by a latch. The bed assembly further includes a rolling table that is rollable into the opening between the sub-structures when the door is unlatched and open and is disguised from view.

19 Claims, 3 Drawing Sheets

IDENTIFICATION BED

BACKGROUND

Field

This disclosure relates generally to a bed structure and, more particularly, to a bed structure that encloses a rolling table for displaying a body for identification.

Discussion of the Related Art

We all die. After death, for some of us our body will be displayed at a funeral home or other facility for our friends and family to view as part of the grieving process prior to being sent to our final resting place. Some of those bodies will be buried in a cemetery or interred in some other fashion and some of those bodies will be cremated. In either case, viewing of the body family and friends automatically provides identification of it. For those that do not choose the traditional way of having a viewing of a body, mix-ups have occurred where bodies have been cremated when that wasn't the intent, which obviously can't be reversed. Therefore, some jurisdictions require an identification process of the body to take place when there isn't a traditional viewing and before cremation to prevent such mistakes.

Funeral homes currently do identification viewings of bodies on removal cots, rolling tables or even through a photograph. Even though all of these things are normal for funeral directors and other people in the industry, it can be unpleasant and distasteful to the general public when seeing a loved one in any of those situations. A more dignified viewing process for body identification would be better.

SUMMARY

The following discussion discloses and describes an identification bed assembly for displaying a body for identification. The bed assembly includes a bed structure having a headboard, a first sub-structure having a head end and a foot end and a second sub-structure having a head end and a foot end, where the head end of the first sub-structure is attached to one side of the headboard and the head end of the second sub-structure is attached to another side of the headboard so that an opening is provided between the first and second sub-structures. The bed structure also includes a first cushion positioned on top of the first sub-structure and a second cushion positioned on top of the second sub-structure. The bed structure further includes a door coupled to the foot end of the first sub-structure by hinges and being latchable to the foot end of the second sub-structure by a latch. The bed assembly further includes a rolling table that is rollable into the opening between the sub-structures when the door is unlatched and open and is disguised from view when the door is closed and latched.

Additional features of the disclosure will become apparent from the following description and appended claims, taken in conjunction with the accompanying drawings.

DETAILED DESCRIPTION OF THE EMBODIMENTS

The following discussion of the embodiments of the disclosure directed to a bed structure that encloses a rolling table for displaying a body for identification is merely exemplary in nature, and is in no way intended to limit the disclosure or its applications or uses.

As discussed above, a dignified viewing process for body identification before cremation is desired. People are generally used to seeing their loved ones in the final stages of their lives in a hospital, nursing home or hospice bed. However, using a traditional bed with a mattress for body identification purposes isn't practical because the mattress would absorb bodily fluids. As will be discussed in detail below, a body identification bed is proposed for use when displaying a body for identification purposes. The proposed bed provides families with a dignified way to say their final goodbyes to a loved one and start the grieving process on a healthy note and also provides a very practical way for funeral directors to display the body. The proposed bed appears to be a traditional bed, but instead the body is actually on a rolling table that rolls into and out of the bed structure through a hinged door at the foot of the bed. The bed is lined with cushions on each side so when a family member feels around while spending their final moments with their deceased loved one, it will seem as if the body is laying on a mattress.

Figure 1:
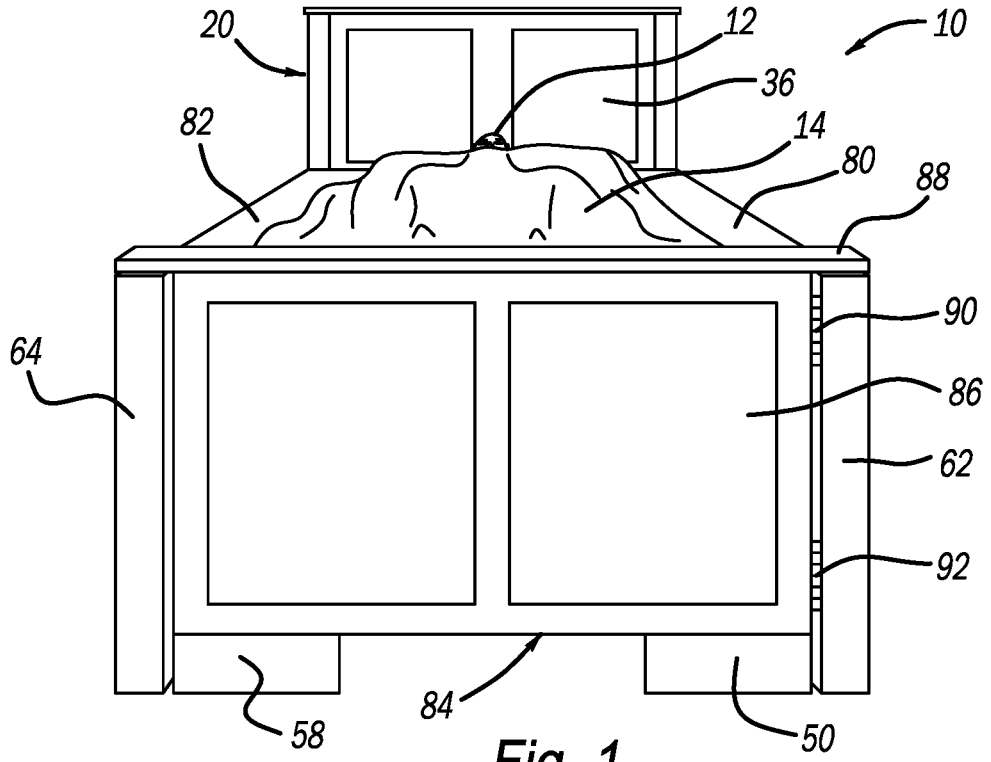
FIG. 1 is an isometric view of an identification bed assembly in a closed position.
Figure 2:
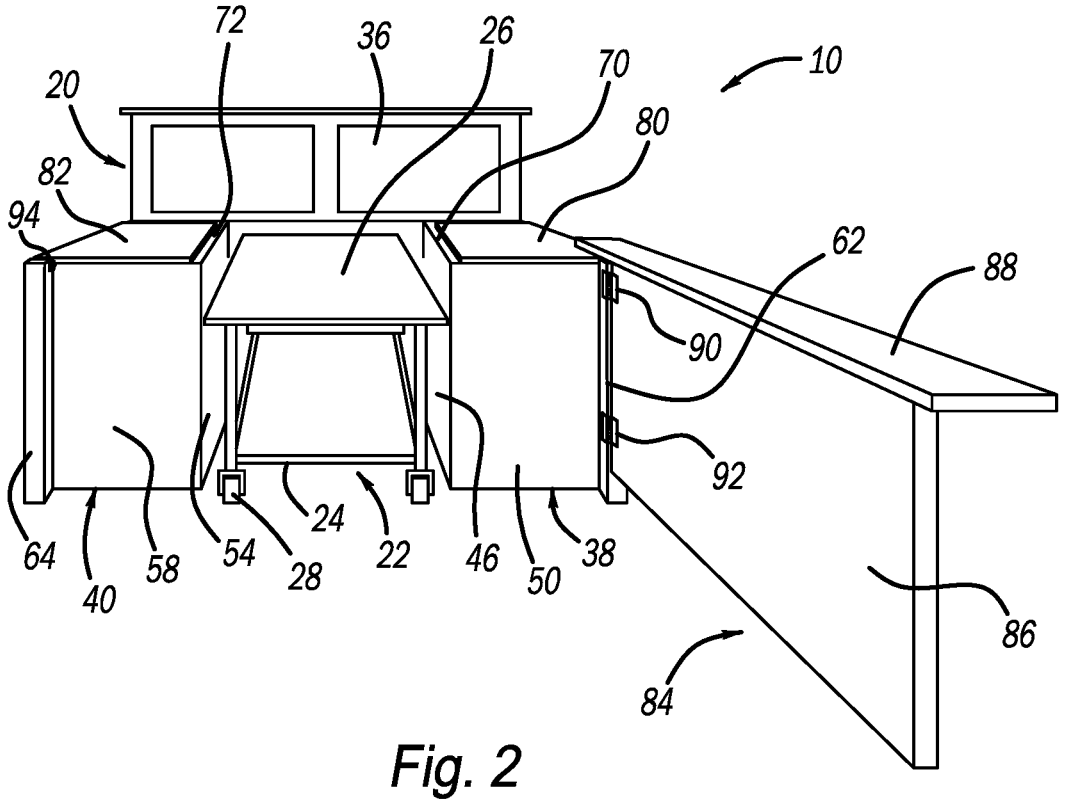
FIG. 2 is an isometric view of the identification bed assembly in an open position.
Figure 3:
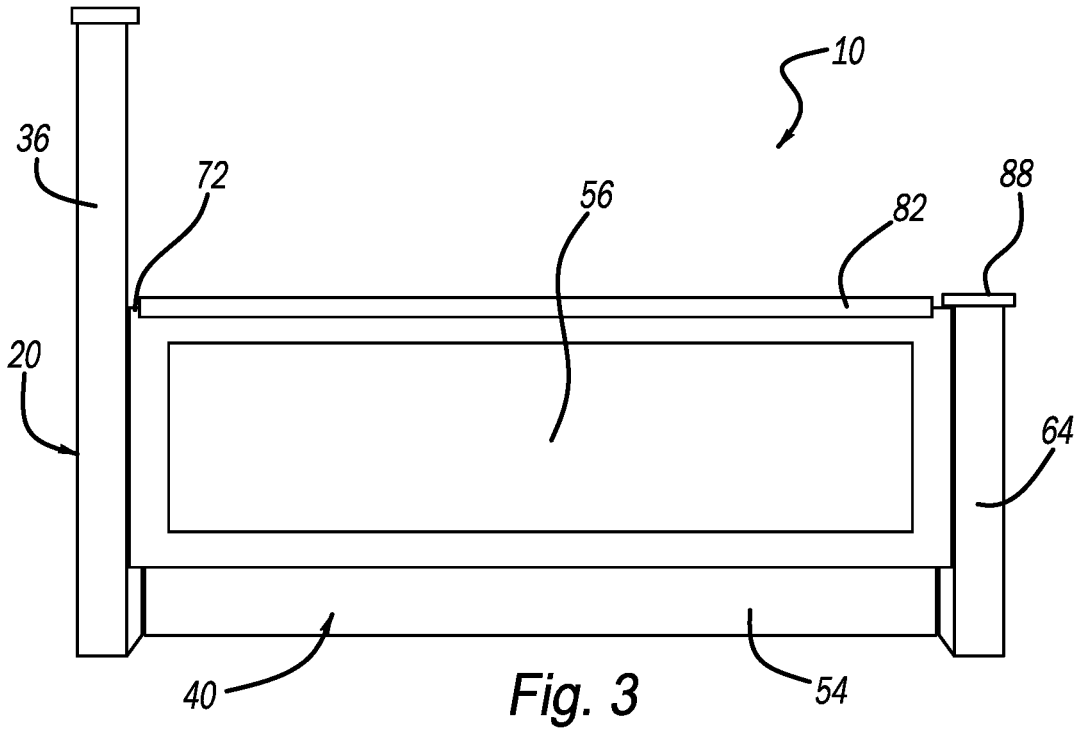
FIG. 3 is a side view of the identification bed assembly in the closed position.
Figure 4:
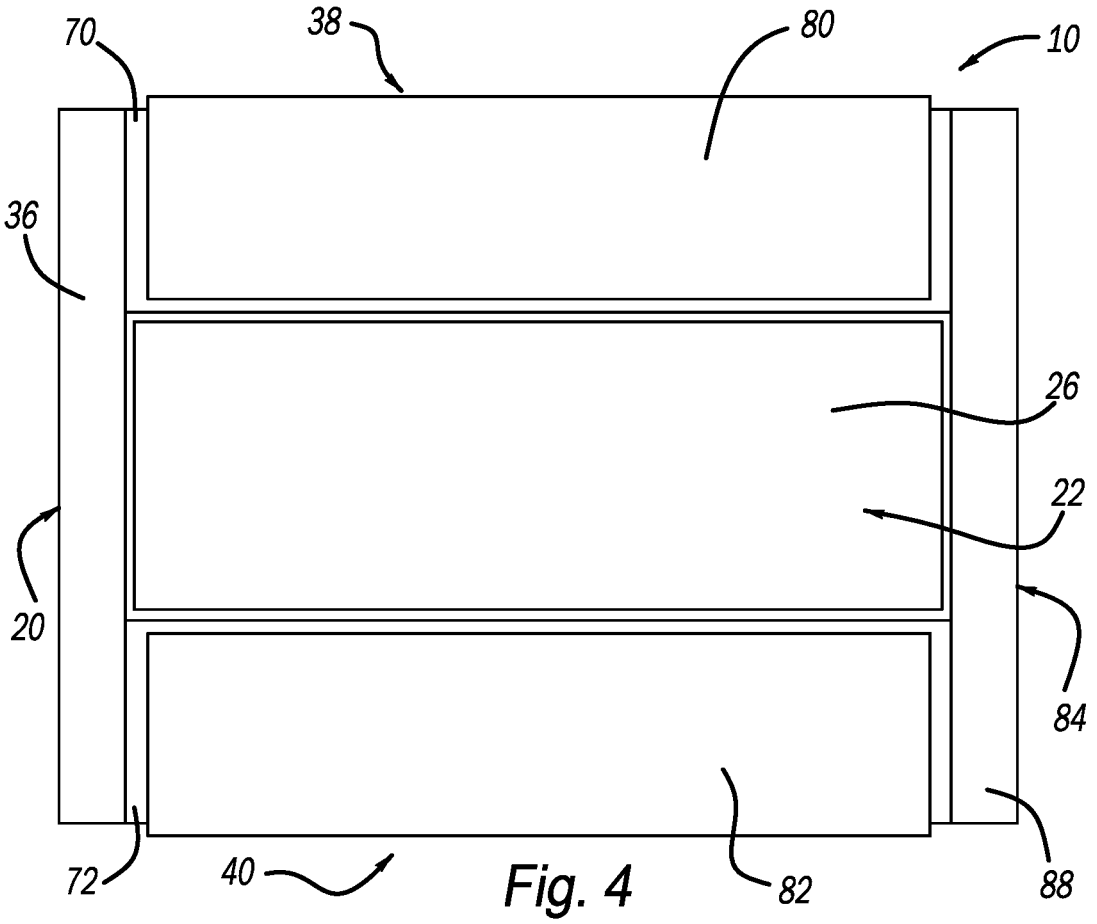
FIG. 4 is a top view of the identification bed assembly in the closed position.

FIG. 1 is an isometric view of a body identification bed assembly 10 in a closed position showing a deceased person 12 under covers 14 and being displayed for identification purposes. FIG. 2 is an isometric view of the identification bed assembly 10 in an open position with the deceased person 12 and the covers 14 removed. FIG. 3 is a side view of the identification bed assembly 10 and FIG. 4 is a top view of the identification bed assembly 10 in the closed position with the deceased person 12 and the covers 14 removed. The bed assembly 10 includes a bed structure 20 and a rolling table 22. The rolling table 22 is intended to represent any known rolling table having a frame 24, a platform 26 mounted to the frame 24 on which the deceased person 12 can lie and wheels 28 mounted to the frame 24 for rolling the table 22 suitable for the purposes discussed herein.

Figure 5:
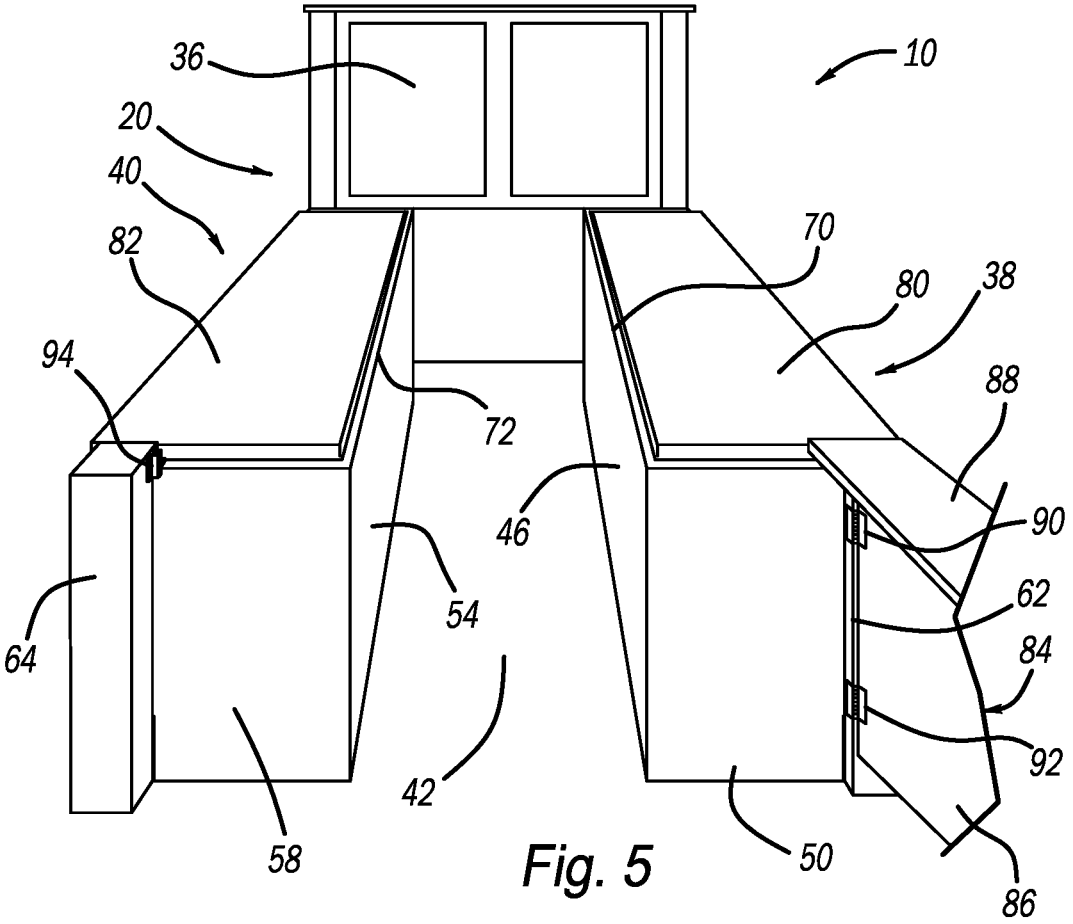
FIG. 5 is an isometric view of the identification bed assembly with the rolling table removed.

FIG. 5 is an isometric view of the bed assembly 10 in the open position with the rolling table 22 removed. The bed structure 20 includes a headboard 36, a first side sub-structure 38 and a second side sub-structure 40 such that a cavity 42 where the rolling table 22 is positioned is defined between the sub-structures 38 and 40. The sub-structure 38 includes side panels 46, an end panel 50 at the foot of the bed structure 20 and a top panel (not shown), and is attached to the headboard 36 opposite to the end panel 50. The sub-structure 40 includes side panels 54 and 56, an end panel 58 at the foot of the bed structure 20 and a top panel (not shown), and is attached to the headboard 36 opposite to the end panel 58. A square post 62 is secured to the end panel 50 and rests on the floor and a square post 64 is secured to the end panel 58 and also rests on the floor. A rim 70 is provided around the top panel of the sub-structure 38 that is open towards the outside side panel and a rim 72 is provided around the top panel of the sub-structure 40 that is open towards the side panel 56. A cushion 80 is positioned on the top panel of the sub-structure 38 against the rim 70 and a cushion 82 is positioned on the top panel of the sub-structure 40 against the rim 72.

Figure 6:
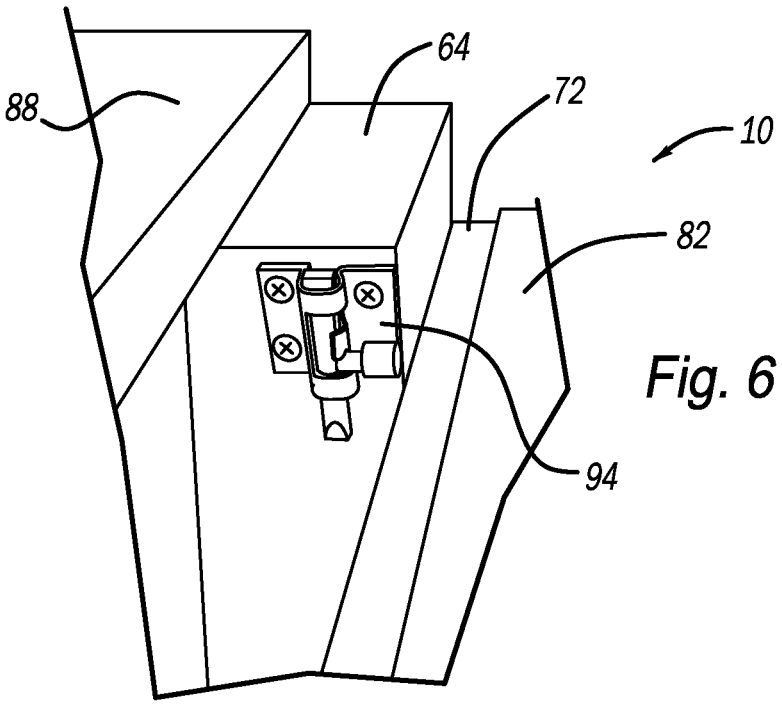
FIG. 6 is an isometric view of a portion of the identification bed assembly showing a door latch.

The bed structure 12 also includes a door 84 having a vertical panel 86 and a top panel 88. The vertical panel 86 is secured to an inside of the post 62 by hinges 90 and 92 at one end. A slidable door latch 94 is screwed to an inside side of the post 64 and is slid into a hole (not shown) in the underside of the top panel 88 when the door 84 is in the closed position to hold it in that position and conceal the rolling table 22. FIG. 6 is an isometric view of a portion of the identification bed assembly 10 in a partially open state showing the latch 94. In the closed position, the top panel 88 covers the top of the posts 62 and 64. When the door 84 is unlatched and opened, the rolling table 22 can be rolled out of the cavity 42, rolled down the hall to a holding room where the deceased person 12 can be replaced with the next deceased person and rolled back into the cavity 42 for his/her identification.

It is noted that the bed structure 20 is made of wood in this non-limiting embodiment where the various panels and pieces are secured together in any suitable manner using screws, dowels, glue, etc. Further, the bed structure 20 is seven feet long and fifty-six inches wide. The cushions 80 and 82 are fourteen inches wide. The top of the platform 26 is slightly lower than the top of the cushions 80 and 82 so that it appears that the deceased person 12 is laying in bed.

The foregoing discussion discloses and describes merely exemplary embodiments of the present disclosure. One skilled in the art will readily recognize from such discussion and from the accompanying drawings and claims that various changes, modifications and variations can be made therein without departing from the spirit and scope of the disclosure as defined in the following claims.

What is claimed is:

1. An identification bed assembly comprising:

a bed structure including a headboard, a first sub-structure having a head end and a foot end and a second sub-structure having a head end and a foot end, wherein the head end of the first sub-structure is attached to one side of the headboard and the head end of the second sub-structure is attached to another side of the headboard so that an opening is provided between the first and second sub-structures, said bed structure further including a door coupled to the foot end of the first sub-structure by hinges and being latchable to the foot end of the second sub-structure by a latch; and a rolling table being rollable into the opening between the sub-structures when the door is unlatched and open and being disguised from view when the door is closed and latched.

2. The bed assembly according to claim 1 further comprising a first cushion positioned on top of the first sub-structure and a second cushion positioned on top of the second sub-structure, said first and second cushions also operating to help disguise the rolling table from view.

3. The bed assembly according to claim 2 wherein the first and second sub-structures are rectangular structures each including opposing side panels, a top panel and an end panel at the foot end of the sub-structure, said cushions positioned on the top panel.

4. The bed assembly according to claim 3 wherein the first sub-structure includes a rim extending around the top panel and being open to an outer one of the side panels, said first cushion being positioned against the rim, and the second sub-structure includes a rim extending around the top panel and being open to an outer one of the side panels, said second cushion being positioned against the rim.

5. The bed assembly according to claim 1 wherein the door includes a vertical panel and a top panel.

6. The bed assembly according to claim 5 wherein the bed structure includes a first post secured to the foot end of the first sub-structure and a second post secured to the foot end of the second sub-structure, and wherein the hinges are mounted to the first post and the vertical panel and the latch is mounted to the second post, said latch being slidably inserted into a hole in the top panel of the door.

7. The bed assembly according to claim 6 wherein the top panel of the door covers the first and second posts when the door is closed and latched.

8. The bed assembly according to claim 1 wherein the rolling table conforms to the size and shape of the opening.

9. An identification bed comprising:

a headboard;

a first structure having a head end and a foot end and a second structure having a head end and a foot end, wherein the head end of the first structure is attached to one side of the headboard and the head end of the second structure is attached to another side of the headboard so that an opening is provided between the first and second structures;

a door coupled to the foot end of the first structure by hinges and being latchable to the foot end of the second structure by a latch; and a first cushion positioned on top of the first structure and a second cushion positioned on top of the second structure.

10. The bed according to claim 9 wherein the first and second structures are rectangular structures each including opposing side panels, a top panel and an end panel at the foot end of the structure, said cushions positioned on the top panel.

11. The bed according to claim 10 wherein the first structure includes a rim extending around the top panel and being open to an outer one of the side panels, said first cushion being positioned against the rim, and the second structure includes a rim extending around the top panel and being open to an outer one of the side panels, said second cushion being positioned against the rim.

12. The bed according to claim 9 wherein the door includes a vertical panel and a top panel.

13. The bed according to claim 12 further comprising a first post secured to the foot end of the first structure and a second post secured to the foot end of the second structure, and wherein the hinges are mounted to the first post and the vertical panel and the latch is mounted to the second post, said latch being slidably inserted into a hole in the top panel of the door.

14. A method for displaying a body for identification, said method comprising:

providing a bed structure including a headboard, a first sub-structure having a head end and a foot end and a second sub-structure having a head end and a foot end, wherein the head end of the first sub-structure is attached to one side of the headboard and the head end of the second sub-structure is attached to another side of the headboard so that an opening is provided between the first and second sub-structures, said bed structure further including a door coupled to the foot end of the first sub-structure by hinges and being latchable to the foot end of the second sub-structure by a latch;

placing the body on a rolling table;

unlatching and opening the door;

rolling the rolling table into the opening between the sub-structures; and closing and latching the door so that the rolling table is positioned within the bed structure and is disguised from view.

15. The method according to claim 14 wherein providing the bed structure further includes providing a first cushion positioned on top of the first sub-structure and a second cushion positioned on top of the second sub-structure, said first and second cushions also operating to help disguise the rolling table from view.

16. The method according to claim 15 wherein the first and second sub-structures are rectangular structures each including opposing side panels, a top panel and an end panel at the foot end of the sub-structure, said cushions positioned on the top panel.

17. The method according to claim 16 wherein the first sub-structure includes a rim extending around the top panel and being open to an outer one of the side panels, said first cushion being positioned against the rim, and the second sub-structure includes a rim extending around the top panel and being open to an outer one of the side panels, said second cushion being positioned against the rim.

18. The method according to claim 14 wherein the door includes a vertical panel and a top panel.

19. The method according to claim 18 wherein the bed structure includes a first post secured to the foot end of the first sub-structure and a second post secured to the foot end of the second sub-structure, and wherein the hinges are mounted to the first post and the vertical panel and the latch is mounted to the second post, said latch being slidably inserted into a hole in the top panel of the door.

* * * * *